US008246283B2

(12) United States Patent
Fujita et al.

(10) Patent No.: US 8,246,283 B2
(45) Date of Patent: Aug. 21, 2012

(54) EQUIPMENT AND METHOD FOR TRANSPORTING RED-HOT COKE

(75) Inventors: Shinsuke Fujita, Kanagawa (JP); Takeshi Sekiguchi, Kanagawa (JP)

(73) Assignee: JP Steel Plantech Co., Yokohama-shi, Kanagawa (JP)

( * ) Notice: Subject to any disclaimer, the term of this patent is extended or adjusted under 35 U.S.C. 154(b) by 980 days.

(21) Appl. No.: 12/225,287

(22) PCT Filed: Apr. 28, 2006

(86) PCT No.: PCT/JP2006/309355

§ 371 (c)(1), (2), (4) Date: Sep. 17, 2008

(87) PCT Pub. No.: WO2007/125609

PCT Pub. Date: Nov. 8, 2007

(65) Prior Publication Data

US 2010/0232913 A1 Sep. 16, 2010

(51) Int. Cl.
*B65G 25/00* (2006.01)

(52) U.S. Cl. ..... 414/154; 414/804

(58) Field of Classification Search ..... 414/147, 414/150, 152, 154, 155, 160, 163, 167, 169, 414/804; 266/165

See application file for complete search history.

(56) References Cited

U.S. PATENT DOCUMENTS

| | | | | | |
|---|---|---|---|---|---|
| 379,390 | A * | 3/1888 | Giles et al. | 414/154 |
| 1,098,374 | A * | 6/1914 | Feicks | 414/163 |
| 1,741,164 | A * | 12/1929 | Puening | 414/163 |
| 1,741,944 | A * | 12/1929 | Linney | 414/152 |
| 2,157,458 | A * | 5/1939 | McEwan et al. | 414/147 |
| 3,517,837 | A * | 6/1970 | Morgenstern et al. | 414/147 |
| 3,942,658 | A * | 3/1976 | Bonnaure | 414/154 |
| 4,087,333 | A * | 5/1978 | Naevestad | 202/227 |
| 4,141,796 | A * | 2/1979 | Clark et al. | 201/39 |
| 4,423,514 | A * | 12/1983 | Davene | 373/79 |
| 2003/0047038 | A1 * | 3/2003 | Iwasaki et al. | 75/707 |

FOREIGN PATENT DOCUMENTS

| | | | |
|---|---|---|---|
| JP | 59-004678 | A | 1/1984 |
| JP | 60-092387 | A | 5/1985 |
| JP | 2006-233100 | A | 9/2006 |

* cited by examiner

*Primary Examiner* — Joshua Rudawitz
(74) *Attorney, Agent, or Firm* — Holtz, Holtz, Goodman & Chick, P.C.

(57) ABSTRACT

Equipment and a method for transporting red-hot coke are provided, which do not need increase in size of a hoist, reinforcement of a CDQ system, and the like, even when the amount capacity of a coke bucket does not correspond to an amount equivalent to the coke amount from one oven chamber. In particular, transporting equipment for red-hot coke, includes: a non-rotary coke receiving car for receiving coke out of a coke oven; a coke bucket for receiving the coke discharged from the coke receiving car; a transporting device for transporting the coke bucket to a hoist position; and a hoist for transporting the coke bucket to a coke dry quenching system.

7 Claims, 12 Drawing Sheets

VIEW ON ARROW A-A

START RECEIVING

DURING TRAVEL OF COKE RECEIVING CAR (SYNCHRONIZED WITH PUSHER STEP)

COMPLETE RECEIVING

EQUIPMENT AND METHOD FOR TRANSPORTING RED-HOT COKE

This application is the United States national phase application of International Application PCT/JP2006/309355 filed Apr. 28, 2006.

TECHNICAL FIELD

The present invention relates to transportation of red-hot coke to a coke dry quenching system.

BACKGROUND ART

FIG. 9 is a cross-section view showing arrangement of a coke dry quenching system (10) (hereinafter, referred to as a CDQ system), receiving equipment for red-hot coke, and transporting equipment, according to the related art. Red-hot coke processed by dry distillation in an oven chamber (or carbonization chamber) (17) of a coke oven is pushed out by a pusher machine after a furnace door (or cover) (18) of the oven chamber (17) is opened, passes through a guide grid (not shown) of a guide car (19), and is loaded into a rotary coke bucket (3) mounted on a coke bucket car (7) that reciprocates on the same rails as that of a coke quenching car (not shown). The coke bucket car (7) mounting the rotary coke bucket (3) having the red-hot coke received travels on the same rails as that of the coke quenching car by way of an electric locomotive (13), and is moved to a position below a hoist tower of the CDQ system (10). Note that the coke quenching car represents a wet quenching car. The rotary coke bucket (3) having the red-hot coke received is replaced with an empty rotary coke bucket (3), hoisted to the top of a tower by a hoist (4), and transported to a charging chute (9) provided at the upper portion of the CDQ system (10), to charge the red-hot coke of the rotary coke bucket (3) into the charging chute (9).

On the other hand, the empty rotary coke bucket (3) is drawn by the electric locomotive (13) to the front of a oven chamber (17) that pushes out the red-hot coke next, and prepares for receiving operation of the red-hot coke. The above-described flow is one cycle of quenching operation in which the red-hot coke out of the coke oven is quenched by the CDQ system (10). Herein, this cycle is based on that the coke is received by the rotary coke bucket (3) by a coke amount from one oven chamber, as an amount for one rotary coke bucket (3), transported by the coke bucket car (7), and charged to the top of the furnace of the CDQ system (10).

However, the size and capability of the coke oven and the CDQ system (10) generally has a wide variety. For example, as shown in a flow chart in FIG. 10 of the related art, when a small coke oven and a large coke oven are operated concurrently, the coke amount from one oven chamber at a time for the small coke oven is small, whereas the number of pushing operations per day is large. Accordingly, the number of transportation operations by the hoist (4) is excessively large, the operation cycle of the hoist (4) is congested, and hence, the transportation capability of the hoist (4) reaches a limit. However, solving this problem results in cost increase because the hoist (4) becomes a device having excessive specifications. In addition, since the furnace lid of the CDQ system (10) is frequently opened or closed, heat loss at the charge of the red-hot coke is increased as compared with that of the related art. In the case of the small coke oven, ordinarily, the space is narrow at the front of the coke oven, and hence, the rotary coke bucket (3) may not be employed, thereby causing particle size segregation of the red-hot coke in the bucket and the quality of coke may be unstable. In flow charts of FIGS. 10 and 11, the rotary coke bucket (3) appears as a circle while the non-rotary coke bucket (3') appears as a rectangle. Regarding the coke amount from one oven chamber, W indicates the case of a small coke oven, 2W indicates the case of a medium coke oven, and 4W indicates the case of a large coke oven. The width of the oven chamber of each coke oven and the area of the coke bucket are varied corresponding to the degree of the coke amount.

In contrast, in the case of the large coke oven as shown in an embodiment at the upper portion (pushing pusher one time) of the large coke oven (the middle row) of FIG. 10, the coke amount, from one oven chamber is large, whereas the number of pushing operations per day is small. Accordingly, the coke amount from one oven chamber and the number of pushing operations may not be balanced with the hoist power of the hoist (4) provided at the CDQ system (10). Thus, it is extremely difficult to operate the CDQ system (10) constantly at the highest level of capability. In addition, since the coke bucket has a heavy load, the hoist power of the hoist (4) may be excessively large, thereby being a device having excessive specifications. If the size of the hoist (4) and the system capacity of the CDQ system (10) are increased, when receiving the coke out of the small coke oven, the speed of the hoist (4) may be increased and the operation cycle of the CDQ system (10) may be congested in relation to the coke amount from one oven chamber. Accordingly, the CDQ system (10) may be inefficient due to excessive machines and congested operation. Noted that the increase in the system capacity of the CDQ system (10) means increase in the size of charging equipment corresponding to the large hoist (4).

As a solution for the above-mentioned problem, as disclosed in Japanese Unexamined Patent Application Publication No. 60-92387 and as shown in an embodiment at the lower portion (pushing pusher two times) of the large coke oven (the middle row) of FIG. 10, which gives the specific configuration of the related art, the amount of the red-hot coke to be charged to the CDQ system (10) is pushed out form the coke oven by dividing the coke into a plurality of groups, and the divided red-hot coke is charged to the CDQ system (10) by the coke bucket having a transportation capability corresponding to the divided coke, in a plurality of times. Accordingly, the hoist (4) and the frame supporting the hoist may be decreased in weight, resulting in cost reduction for equipment.

However, with the configuration disclosed in Japanese Unexamined Patent Application Publication No. 60-92387, the time for pushing per one oven chamber is increased. Accordingly, the worker-hour is increased and the operation becomes troublesome in a case where the number of coke oven chambers is large. Thus, it is difficult to attain the above subject to improve operation efficiency of the CDQ system only by the improvement in the operation method of the coke oven. In addition, in the configuration disclosed in Japanese Unexamined Patent Application Publication No. 60-92387, pushing operation is forcibly stopped during the pushing operation, the red-hot coke at 1000° C. remaining in the oven chamber may be spread around and fall, and the red-hot coke may not be received safely. Also, the next empty coke bucket car is necessary to be moved promptly to the front of the oven chamber before the red-hot coke, the pushing of which is stopped, falls. Thus, the realization may be difficult.

The CDQ system (10) is typically installed later to the coke oven which has been operated, for the purpose of exhaust heat recovering and environmental improvement. The capacity of the rotary coke bucket (3) generally corresponds to the coke amount from one oven chamber, and thus, the size of the rotary coke bucket (3) is also determined accordingly.

However, in the case of the existing small coke oven, since the width of the lateral surface of the existing coke wet quenching car is small, it may be difficult to install the coke bucket car (7) having the rotary coke bucket (3) later. Even in the case of the medium coke oven, as shown in an embodiment at the lower portion (non-rotary coke bucket (3')) of the medium coke oven (lower row) in FIG. 10, the rotary coke bucket (3) may not be fit in due to the small width of the space between the front of the coke oven and the rails, for receiving the red-hot coke. Accordingly, the non-rotary coke bucket (3') must be used instead.

As a result, the advantages of the rotary coke bucket (3) may not be attained. The operation of the CDQ system (10) may be inefficient and unstable. Due to this, the quality of coke may be unstable.

Accordingly, an object of the present invention to provide equipment and a method for red-hot coke capable of eliminating the necessity of increase in speed of the hoist (4) and a congested operation cycle of the CDQ system (10). In this configuration, as shown in the small coke oven chamber shown in FIG. 11 (upper row), in the case where the amount capacity of the coke bucket (3, 3') does not correspond to the coke amount from one oven chamber, the newly installed non-rotary coke receiving car (1) (using the rails for the existing coke wet quenching car), having the capacity equivalent to the coke amount from one oven chamber or more, once receives the red-hot coke, and then the coke receiving car (1) discharges the red-hot coke by a coke amount of two or more oven chambers to the coke bucket (3, 3'), which is newly provided adjacently to the rails for the existing coke wet quenching car, in accordance with its capacity, instead of that the coke bucket (3, 3') directly receives the red-hot coke from the coke oven.

The coke bucket (3, 3') mentioned here according to the present invention is a rotary coke bucket (3) or a non-rotary coke bucket (3'). When just referring to the coke bucket, it may include both the rotary coke bucket (3) and the non-rotary coke bucket (3') unless otherwise specified.

In addition, another object of the present invention to provide the optimum operation for the CDQ system (10) in which the particle size segregation of coke is small. In this operation, in the case where the amount capacity of the coke bucket (3, 3') corresponds to the coke amount from one oven chamber, if it is difficult to newly provide the rotary coke bucket (3) due to the narrow space at the existing coke oven, the newly provided non-rotary coke receiving bucket (1) (using the rails for the existing coke wet quenching car) once receives the red-hot coke, and then the coke receiving car (1) discharges the red-hot coke by a coke amount of two or more oven chambers to the coke bucket (3, 3'), which is newly provided adjacently to the rails for the existing coke wet quenching car, in accordance with its capacity, instead of that the coke bucket (3, 3') directly receives the red-hot coke from the coke oven.

Further, still another object of the present invention is to provide compact and inexpensive equipment without increase in size of transporting equipment for red-hot coke (including the rotary coke bucket, hoist, coke bucket car, and the like). In this configuration, as shown in the large coke oven (middle row) shown in FIG. 11, the newly provided non-rotary coke receiving bucket (1) (using the rails for the existing coke wet quenching car) once receives the red-hot coke by distributing the coke into two or more chambers, and then the coke receiving car (1) discharges the red-hot coke by a coke amount corresponding to the coke bucket (3, 3'), which is newly provided adjacently to the rails for the existing coke wet quenching car, in accordance with its capacity, instead of that the coke bucket (3, 3') directly receives the red-hot coke from the coke oven chamber.

Further object of the present invention is to provide the optimum operation for the CDQ system (10) that may attain the advantages of the rotary coke bucket (3). In this operation, as shown in the lower row representing the medium coke oven shown in FIG. 11, even when the rotary coke bucket (3) may not be installed due to the small width of the space between the front of the coke oven and the rails for receiving the red-hot coke, the non-rotary coke receiving car (1) once receives the red-hot coke, and then discharges the red-hot coke to the newly provided rotary coke bucket (3), instead of that the coke bucket (3') directly receives the red-hot coke from the coke oven.

In addition, further object of the present invention is to provide equipment and a method for transporting red-hot coke without the necessity of increase in size of the hoist (4) and the reinforcement of the CDQ system (10). In this configuration, when the amount capacity of the coke bucket (3, 3') does not correspond to the coke amount from one oven chamber, the non-rotary coke receiving car (1) having the capacity corresponding to the coke amount from one oven chamber once receives the red-hot coke, and then controls the amount of discharge in accordance with the capacity of the coke bucket (3, 3'), instead of the coke bucket (3, 3') receives the red-hot coke directly from the coke oven.

In addition, another object of the present invention is to provide the optimum operation for the CDQ system (10) in which the particle size segregation of coke is small. In this operation, in the case where the amount capacity of the coke bucket (3, 3') corresponds to the coke amount from one oven chamber, if it is difficult to newly provide the rotary coke bucket (3) due to the narrow space at the existing coke oven, the newly provided non-rotary coke receiving bucket (1) (using the rails for the existing coke wet quenching car) once receives the red-hot coke, and then the coke receiving car (1) discharges the red-hot coke by a coke amount from two or more oven chambers to the coke bucket (3, 3'), which is newly provided adjacently to the rails for the existing coke wet quenching car, in accordance with its capacity, instead of that the coke bucket (3, 3') directly receives the red-hot coke from the coke oven.

DISCLOSURE OF INVENTION

To solve the above-described problems, there are provided features of the present invention as follows.

(1) A first invention is transporting equipment for red-hot coke, including: a non-rotary coke receiving car for receiving coke out of a coke oven chamber; a coke bucket for receiving the coke discharged from the coke receiving car; a transporting device for transporting the coke bucket to a hoist position; and a hoist for transporting the coke bucket to a coke dry quenching system.

(2) A second invention is the transporting equipment for red-hot coke according to (1), further including one or two sets of discharge equipment are provided for discharging the coke from the coke receiving car to the coke bucket.

Herein, note that the discharge equipment (16) includes the discharge chute (2) and the dust collector hood (11) as shown in FIGS. 1, 3, 5 and 7.

(3) A third invention is the transporting equipment for red-hot coke according to (1) or (2), in which the transporting device is a turning table disposed on the ground or under the ground, and at least two of the coke buckets are disposed on the turning table.

(4) A fourth invention is the transporting equipment for red-hot coke according to (1) or (2), in which the transporting device is a coke bucket car, and the coke bucket car travels along a circular rail, or a straight-line rail that is arranged in parallel to a travel rail of the non-rotary coke receiving car.

(5) A fifth invention is the transporting equipment for red-hot coke according to (1) or (2), comprising: a coke bucket mounted on the transporting device and having a capacity corresponding to a coke amount from two or more oven chambers; and the hoist for transporting the coke bucket to the coke dry quenching system.

(6) A sixth invention is a transporting method for red-hot coke, comprising the steps of: receiving coke out of a small coke oven by a non-rotary coke receiving car; receiving the coke by a coke bucket; repeating the preceding two receiving steps at least two times; transporting the coke bucket that has received the coke by a coke amount from two or more oven chambers, to a hoist position; and hoisting the coke bucket by a hoist, and charging the red-hot coke into a coke dry quenching system.

(7) A seventh invention is the transporting method for red-hot coke according to (6), in which a coke amount from the one small coke oven chamber is 20 ton or less.

(8) An eighth invention is a transporting method for red-hot coke, comprising the steps of: receiving coke out of a large coke oven chamber by a non-rotary coke receiving car fitting up at least two chambers; discharging the coke by a coke amount from the one chamber to a first coke bucket; transporting the first coke bucket to a hoist position; hoisting the first coke bucket, and charging the red-hot coke into a coke dry quenching system; then, discharging the coke by a coke amount from the residual chamber to an empty second coke bucket; transporting the second coke bucket to the hoist position; and hoisting the second coke bucket, and charging the red-hot coke into the coke dry quenching system.

(9) A ninth invention is the transporting method for red-hot coke according to (8), in which a coke amount from the one large coke oven chamber is 30 ton or more.

(10) A tenth invention is the transporting equipment or the transporting method according to any one of (1) to (9), in which the coke bucket is a rotary coke bucket.

Advantages of the Invention (1) With the present invention, the transporting processing for the red-hot coke may be performed efficiently, based on the optimum capacity of the coke bucket (3, 3') and the optimum cycle time of the hoist (4) that are suitable for the capability of the CDQ system (10) regardless of the operation conditions such as the coke amount from one oven chamber, and the number of pushing operations. In particular, in the case of the small coke oven, the two or more non-rotary coke receiving cars (1) receive the red-hot coke by an amount equivalent to the coke amount from two or more oven chambers, and discharge that amount of red-hot coke to the one rotary coke bucket (3) or non-rotary coke bucket (3'). Accordingly, it is possible to employ the optimum capacity of the coke bucket (3, 3') and the optimum cycle time of the hoist (4) that are suitable for the capability of the CDQ system (10).

Also, in the case of the large coke oven, the non-rotary coke receiving car (1) receive the red-hot coke by an amount equivalent to the coke amount from one oven chamber, by distributing the coke into two or more chambers, and discharges the red-hot coke to the rotary coke bucket (3) or non-rotary coke bucket (3') in accordance with the capacity of the coke bucket (3, 3'). Accordingly, the equipment may be compact and inexpensive without increase in the size of the transporting equipment for red-hot coke (including the rotary coke bucket (3) or non-rotary coke bucket (3'), the hoist (4), the coke bucket car (7), and the like).

(2) With the present invention, when the CDQ system (10) is provided at the existing coke oven, the non-rotary coke receiving car (1), the coke bucket (3, 3'), and its transporting device are newly provided using the rails for the existing coke wet quenching car, so as to transport the red-hot coke to the CDQ system (10). Accordingly, the configuration may be applied to the CDQ system (10) having a predetermined characteristic without major conversion of the coke oven.

(3) In addition, since the travel rails for the non-rotary coke receiving car are the same as that of the coke wet quenching car, the existing coke wet quenching car as well as a coke quenching tower (sprinkler equipment) disposed in the extension of the rails may be used. Accordingly, even if the CDQ system (10) may not receive the red-hot coke for some reason, the system may be easily switched to the coke wet quenching equipment to transport the red-hot coke, thereby achieving safety.

(4) In addition, with the present invention, it is possible to use the coke bucket (3, 3') of a uniform capacity, while the small coke oven, the medium coke oven, and the large coke oven are concurrently operated, thereby enhancing the operation efficiency of the CDQ system (10).

REFERENCE NUMERALS

Figure 1:
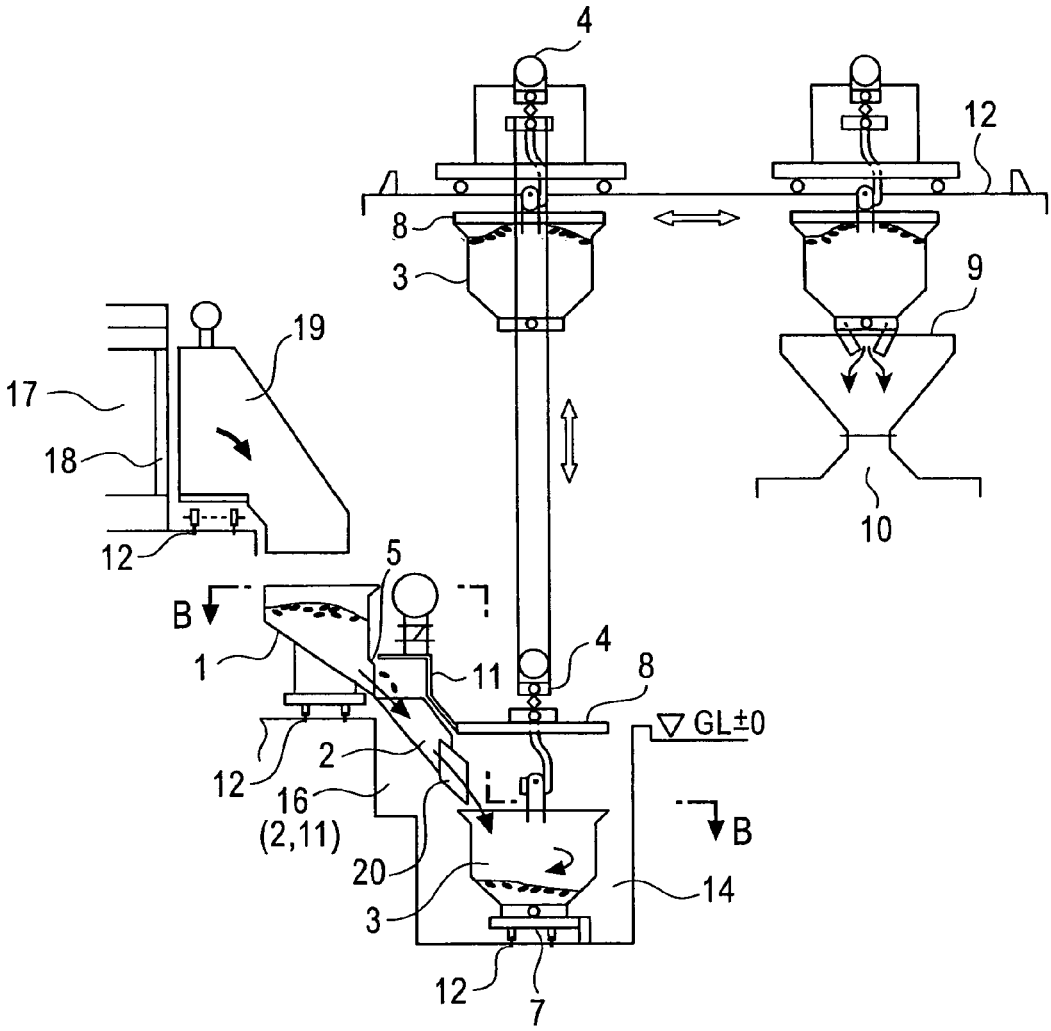
FIG. 1 is a cross-section view showing a case where a piece of discharge equipment (16) for red-hot coke is disposed (corresponding to a small coke oven).

1 non-rotary coke receiving car
2 discharge chute
3 rotary coke bucket
3' non-rotary coke bucket
4 hoist
5 discharge gate
7 coke bucket car
8 coke bucket cover
9 charging chute
10 CDQ system
11 dust collector hood
12 rail
13 electric locomotive
14 underground pit
15 turning table
16 coke discharge equipment
17 oven chamber of coke oven
18 furnace door
19 guide car
20 assistant discharge chute
21 separation wall

BEST MODE FOR CARRYING OUT THE INVENTION

An embodiment of the present invention will be described below with reference to the drawings.

Figure 2:
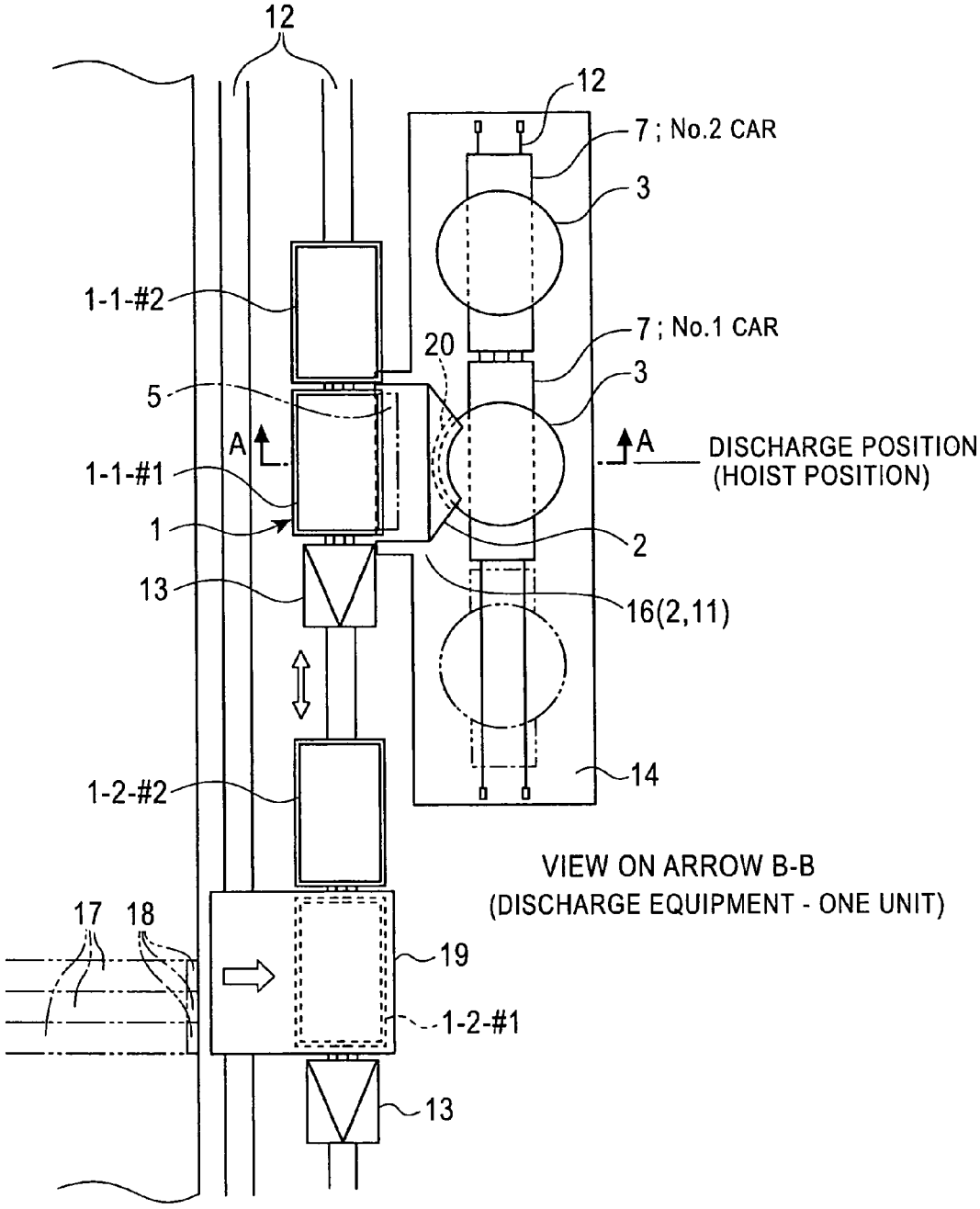
FIG. 2 is a plan view showing the details of the discharge equipment (16) for red-hot coke in FIG. 1 (corresponding to the small coke oven).
Figure 3:
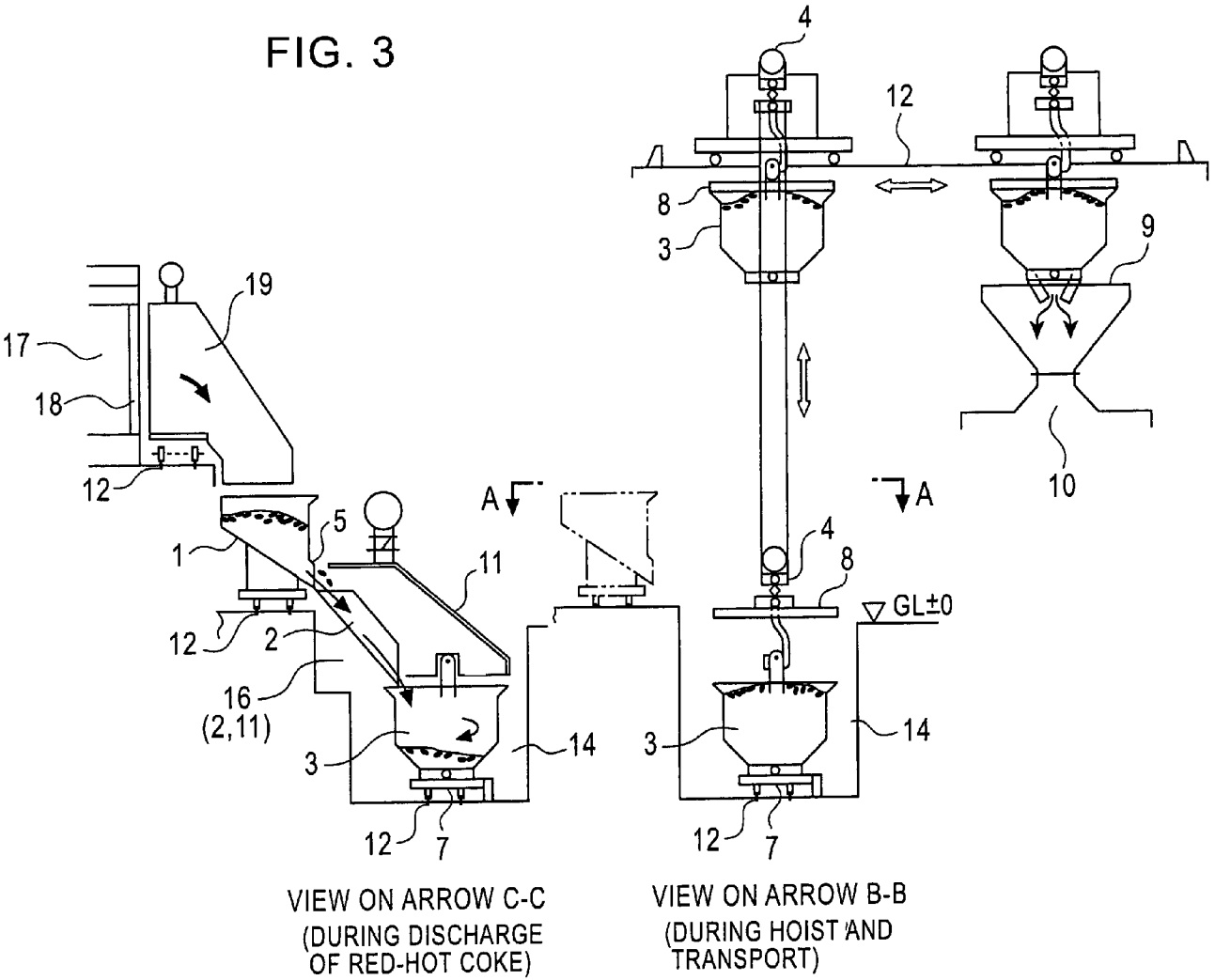
FIG. 3 is a cross-section view showing a case where two sets of discharge equipment (16) for red-hot coke are disposed (corresponding to a small coke oven).
Figure 4:
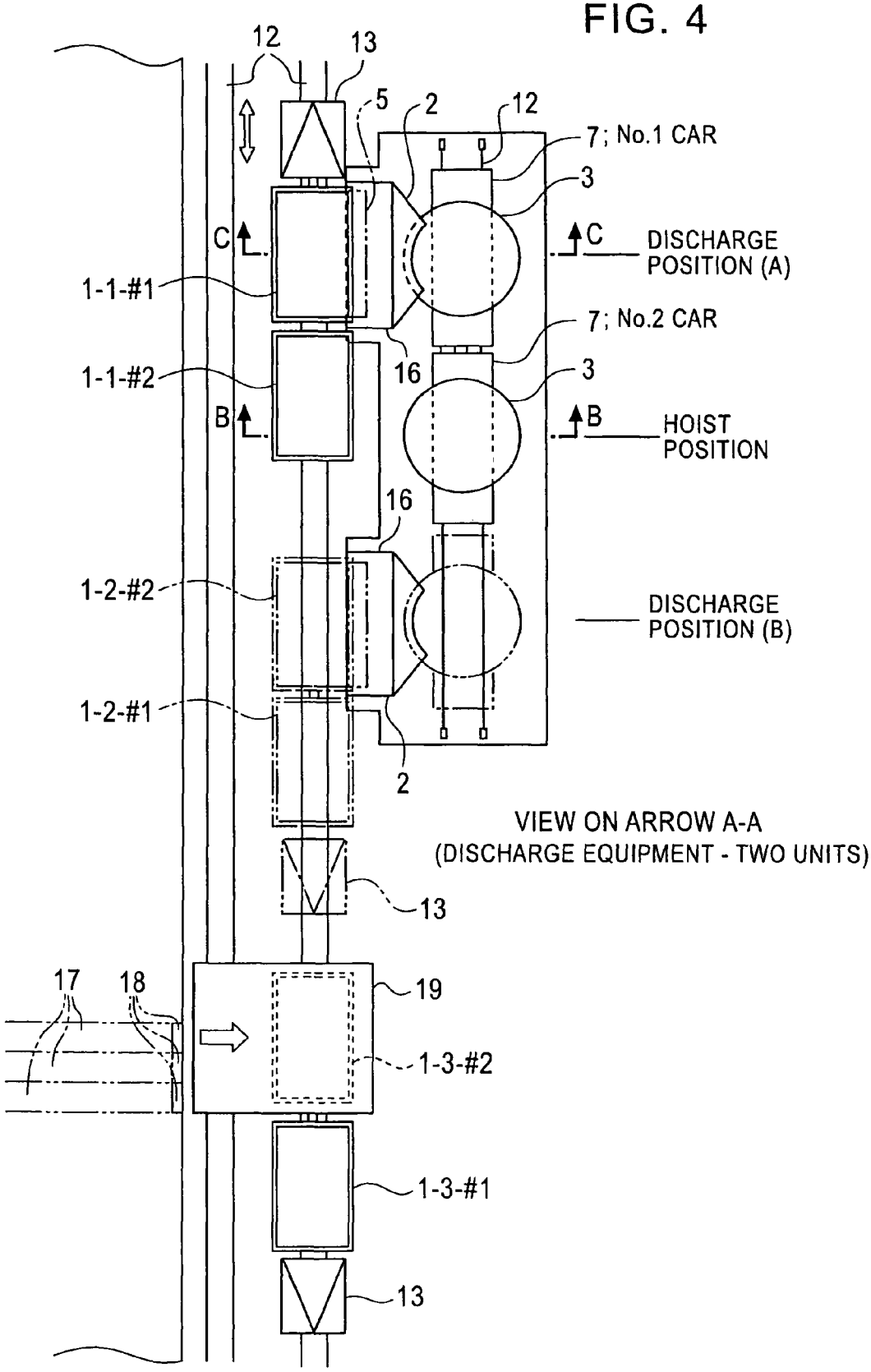
FIG. 4 is a plan view showing the details of the discharge equipment (16) for red-hot coke in FIG. 3 (corresponding to the small coke oven).

FIGS. 1 to 4 are drawings of equipment of the present invention for a case where a coke amount from one oven chamber is small and the number of pushing operations is large (hereinafter, referred to as a case for a small coke oven, the small coke oven being defined such that a coke amount from one oven chamber is 20 ton or less (typically around 10 ton)). FIGS. 1 and 2 are a cross-section view and a plan view showing a case where a piece of discharge equipment (16) for red-hot coke is provided. FIGS. 3 and 4 are a cross-section view and a plan view showing a case where two sets of discharge equipment (16) for red-hot coke are provided.

Figure 5:
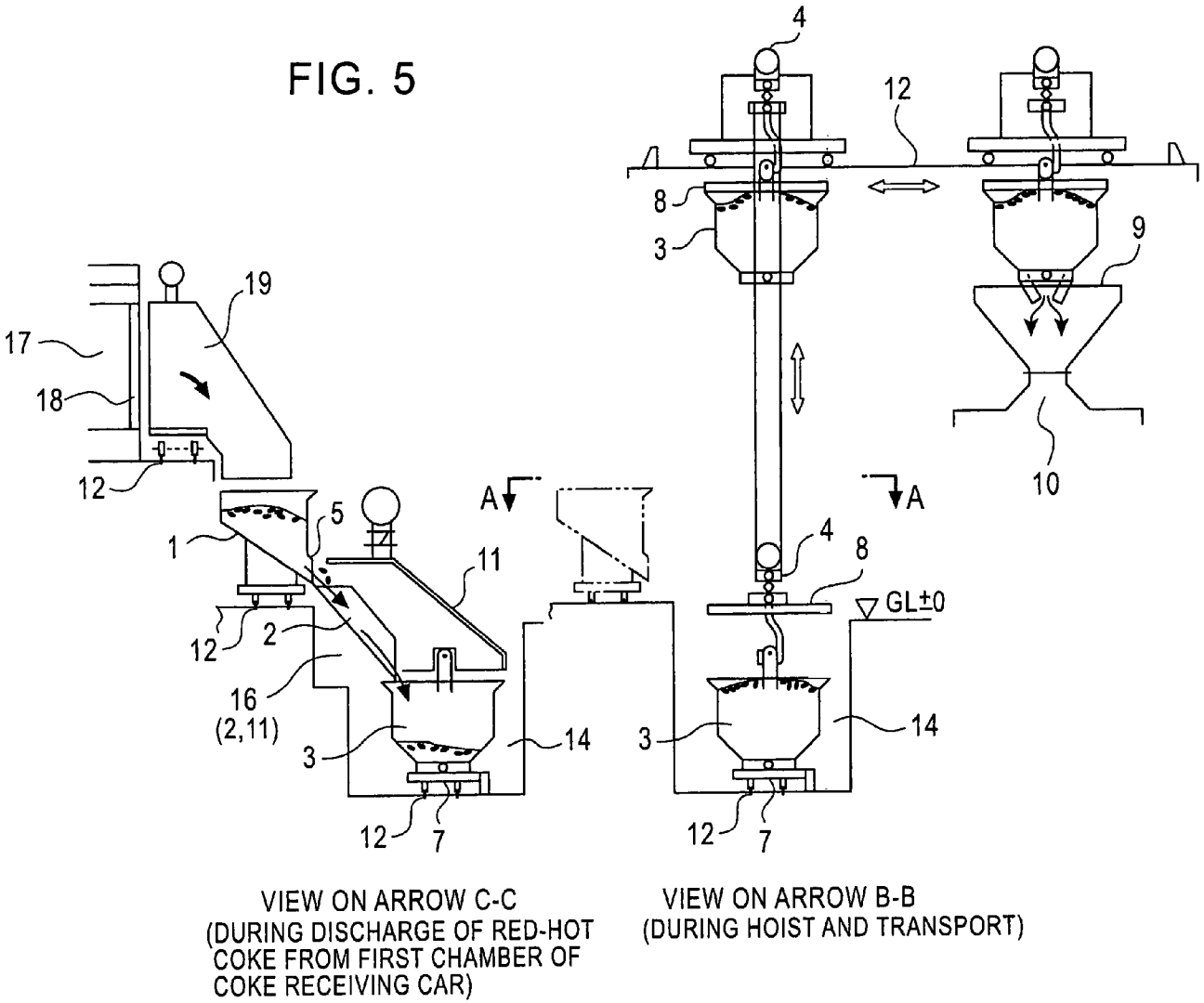
FIG. 5 is a cross-section view showing a case where two sets of discharge equipment (16) for red-hot coke are disposed (corresponding to a large coke oven).
Figure 6:
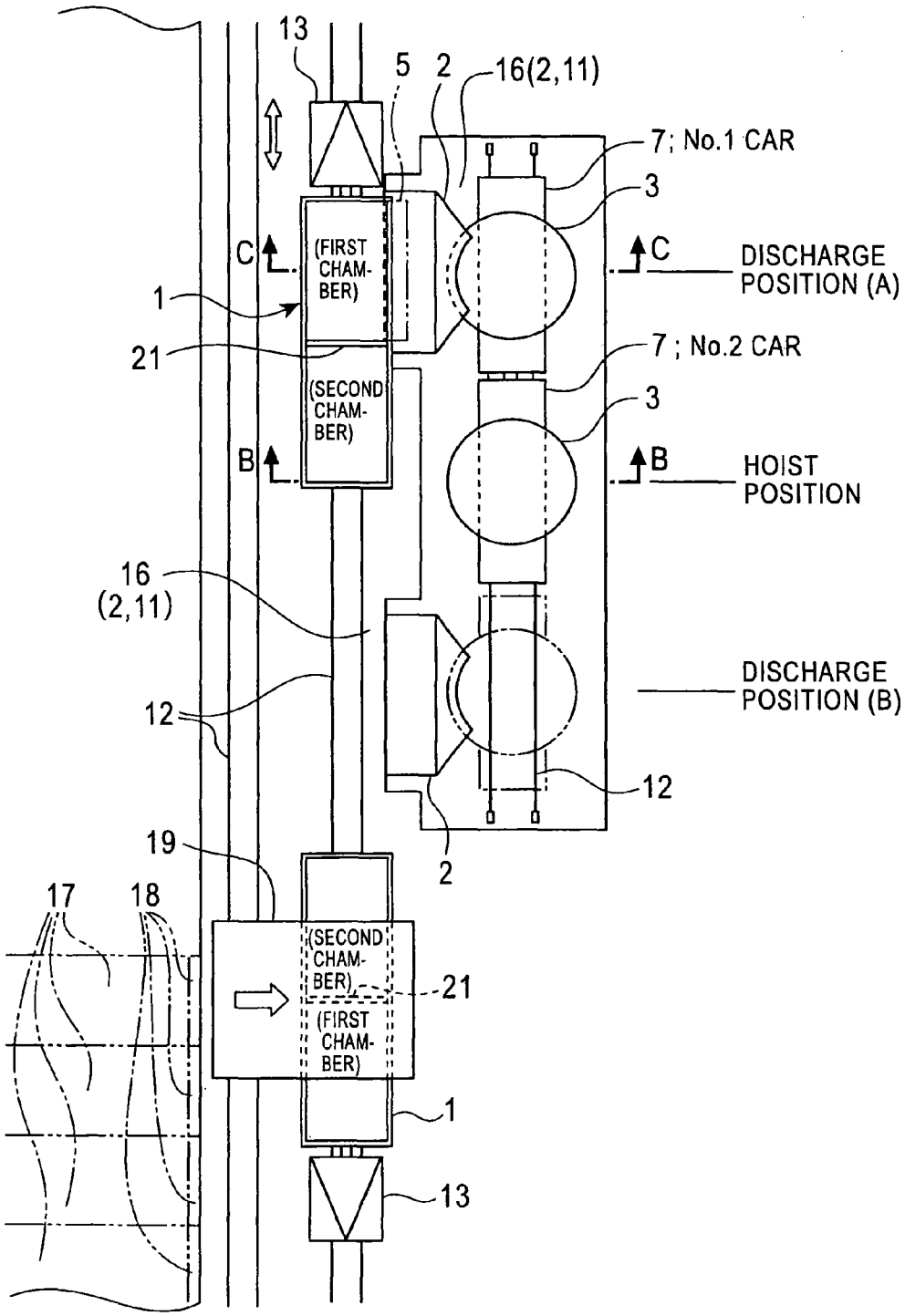
FIG. 6 is a plan view showing the details of the discharge equipment (16) for red-hot coke in FIG. 5 (corresponding to the large coke oven).

FIGS. 5 and 6 are drawings of equipment of the present invention for a case where a coke amount from one oven chamber is large and the number of pushing operations is small (hereinafter, referred to as a case for a large coke oven, the large coke oven being defined such that a coke amount from one oven chamber is 30 ton or more). FIGS. 5 and 6 are a cross-section view and a plan view showing a case where two sets of discharge equipment (16) for red-hot coke are disposed, and besides, a non-rotary coke receiving car (1) is divided into two chambers.

(A) Case for Small Coke Oven (Small Coke Oven Being Defined Such that Coke Amount from One Oven Chamber is 20 Ton or Less (Around 10 ton))

Referring to FIGS. 1 and 2, the non-rotary coke receiving car (1) that has received coke out of a coke oven travels to the discharge equipment (16), discharges red-hot coke in the discharge equipment (16), and a rotary coke bucket (3) receives the coke through a discharge chute (2) covered with a dust collector hood (11). Herein, note that the discharge equipment (16) includes the discharge chute (2) and the dust collector hood (11) as shown in FIGS. 1, 3, 5 and 7.

Rotating the rotary coke bucket (3) during reception of the red-hot coke provides a coke layer with a small particle size segregation in circumferential direction. Accordingly, the red-hot coke may be cooled uniformly in a furnace of a CDQ. As shown in FIG. 2, a coke bucket car (7) has a two-car arrangement. The rotary coke buckets (3) are disposed at each of cars (No. 1 car and No. 2 car). While the rotary coke bucket (3) on the No. 1 car, in which the red-hot coke has been mounted (by a coke amount from two oven chambers of 1-1-#1 and 1-1-#2), is hoisted and moved to a CDQ system (10), the empty rotary coke bucket (3) on the No. 2 car is moved to a receiving position (discharge equipment (16)), an assistant discharge chute (20) provided at the discharge chute (2) is moved downward (to stop falling), and then, receives the red-hot coke from another non-rotary coke receiving car (1) (1-2-#1 and 1-2-#2). When the red-hot coke has been mounted in the No. 2 car (by a coke amount from two oven chambers of 1-2-#1 and 1-2-#2), the assistant discharge chute (20) of the discharge chute (2) is moved upward (to avoid interference), and then, the red-hot coke in the No. 2 car at the receiving position is retracted once (i.e., it is moved to an upper position of the No. 2 car shown in FIG. 2). Accordingly, the empty car (No. 1 car in FIG. 2) is located at a waiting position, and hence, the returning empty coke bucket after charging to the above-mentioned CDQ system (10) may be restored. The empty coke bucket is put on the empty coke bucket car, then, the retracted red-hot coke is moved to the hoist position, and the red-hot coke is hoisted by a hoist (4) in the same manner as the No. 1 car, to be transported to the CDQ system (10). Since rails (12) for the non-rotary coke receiving car (1) are provided in parallel to rails (12) for the coke bucket car (7), operations of these cars do not interferer with each other, thereby achieving smooth transportation of the red-hot coke.

In FIGS. 3 and 4, two sets of discharge equipment (16) are disposed so as to further enhance processing efficiency.

FIG. 4 is a plan view showing a case where two sets of discharge equipment (16) are disposed at two positions (discharge positions (A) and (B)). FIG. 4 shows the discharge equipment (16), rotary coke buckets (3) and non-rotary coke receiving cars (1) (1-1-#1 and 1-1-#2, or 1-2-#1 and 1-2-#2) each having a two-car arrangement.

The coke bucket car (7) has a two-car arrangement at the receiving position (A) shown in FIG. 4, when the red-hot coke amount on the one non-rotary coke receiving car (1) has been received by the rotary coke bucket (3) on the No. 1 car (by a coke amount from two oven chambers of 1-1-#1 and 1-1-#2), the No. 1 car is moved to a hoist position. Accordingly, the empty rotary coke bucket (3) on the No. 2 car is moved to another receiving position (B) (discharge equipment (16)), and it may receive the red-hot coke discharged from the other non-rotary coke receiving car (1) (by a coke amount from two oven chambers of 1-2-#1 and 1-2-#2). During the receiving, the returning empty coke bucket after charging to the CDQ system (10) is put on the No. 1 car (empty car), which was hung as described above, and the empty coke bucket is in a state before it is moved to the next receiving position. The red-hot coke is discharged alternately from the two discharge positions (A and B) (discharge equipment (16)), and the red-hot coke is transported by the hoist (4) sequentially at a hoist position toward the CDQ system (10).

Figure 7:
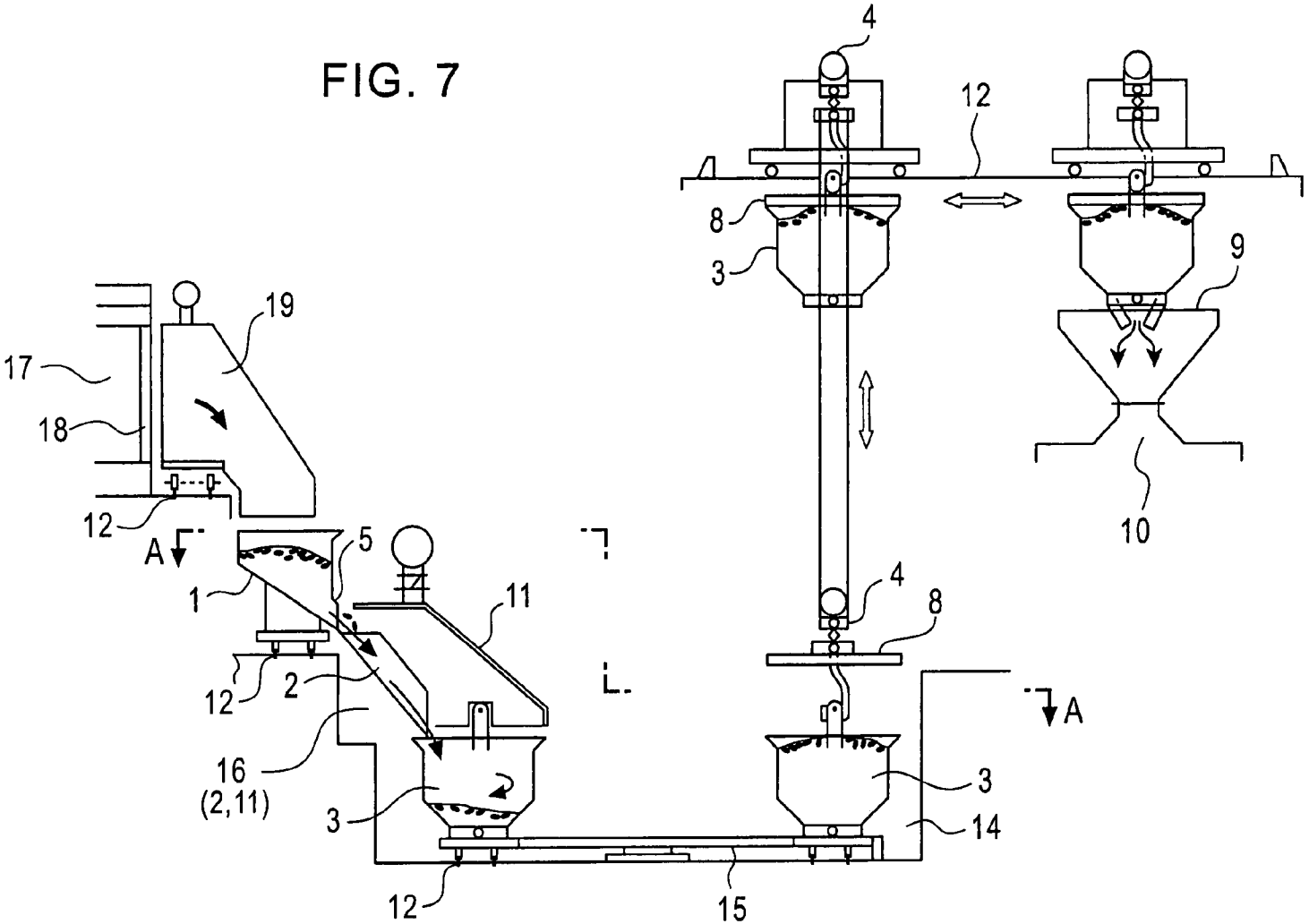
FIG. 7 is a cross-section view showing a case where rotary coke buckets (3) are disposed on a turning table (15).
Figure 8:
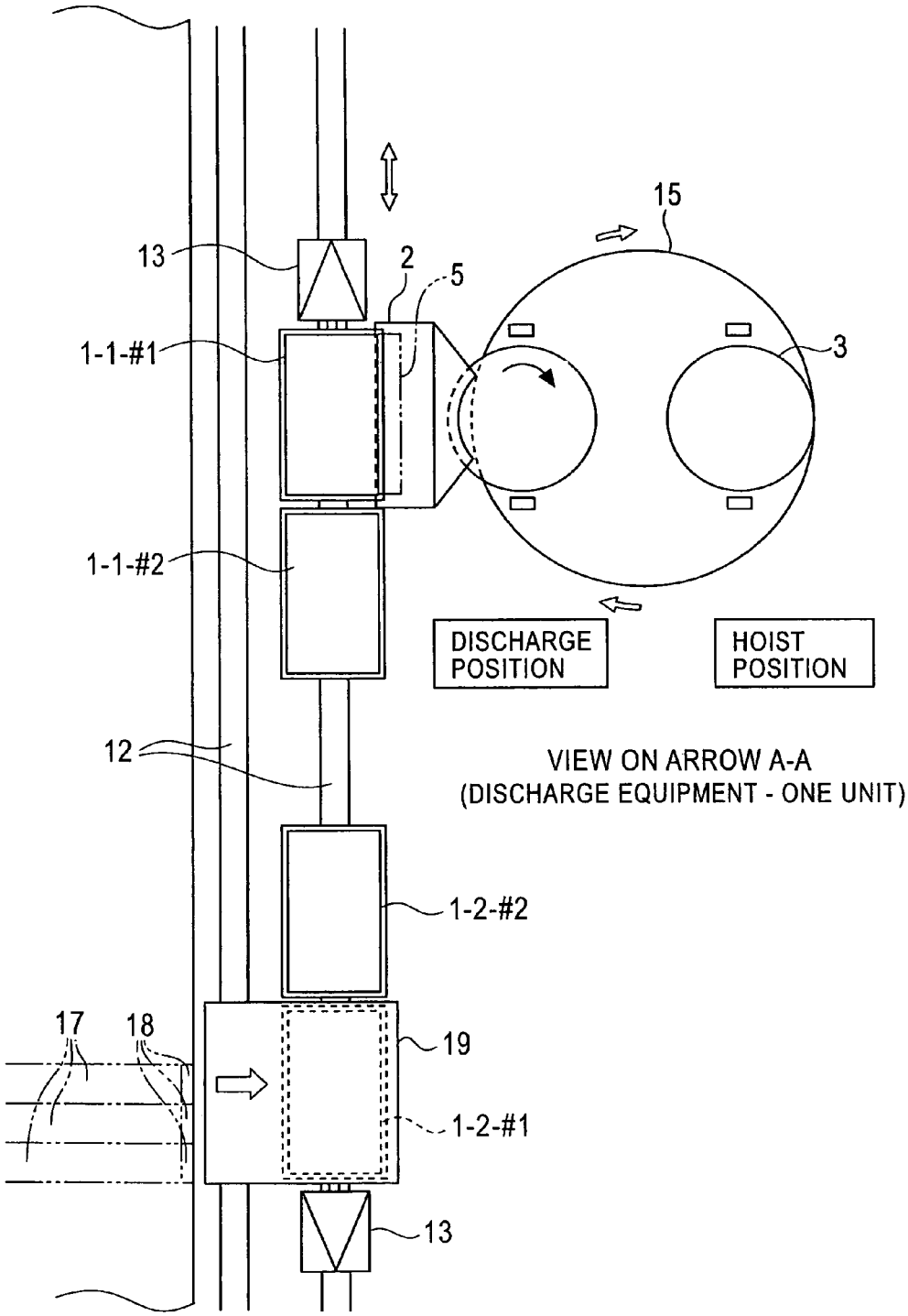
FIG. 8 is a plan view showing the case where the rotary coke buckets (3) in FIG. 7 are disposed on the turning table (15).
Figure 9:
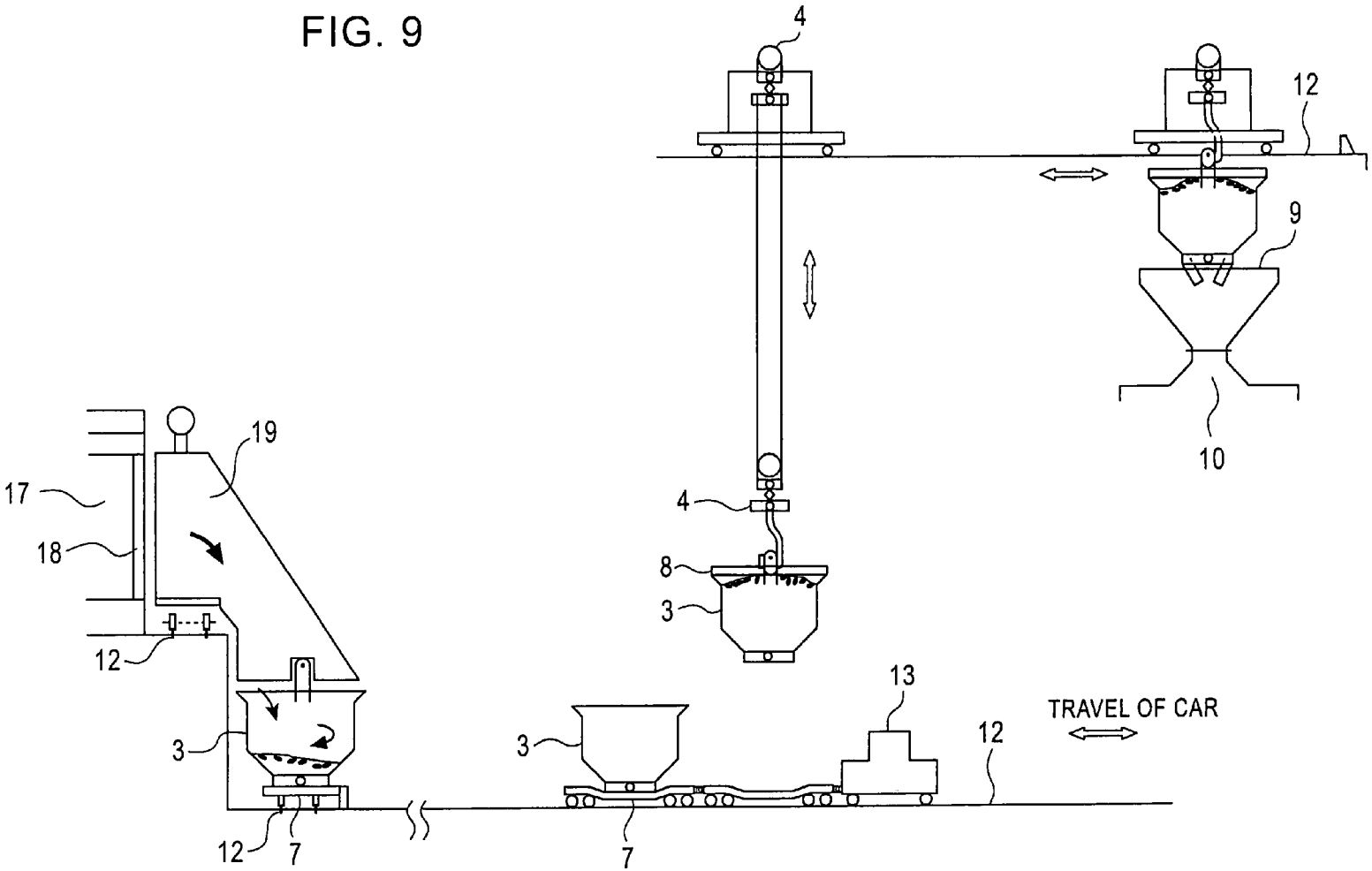
FIG. 9 is an explanatory view showing equipment and a method for transporting red-hot coke according to the related art.

While rails (12) for the coke bucket car (7) are straight-line rails (12) in FIGS. 1 to 4, there may be an arrangement as shown in FIGS. 7 and 8, in which at least two rotary coke buckets (3) are disposed on a turning table (15), and the turning table (15) is turned to sequentially receive the red-hot coke. Alternatively, though not shown, the coke bucket car (7) with the rotary coke bucket (3) amounted may travel on looped rails.

Components suitable for the present invention and applied to a small coke oven will be described below.

(1) Non-Rotary Coke Receiving Car (1)

The non-rotary coke receiving car (1) in the case of the small coke oven is newly provided using the existing rails (12) for the coke wet quenching car. Or, the existing coke wet quenching car may be used as a substitute.

The non-rotary coke receiving car (1) has the equipment specification corresponding to a transportation cycle of coke in accordance with the arrangement conditions of the subject coke oven and CDQ system (10). The equipment specification of the non-rotary coke receiving car (1) is determined on the basis of a variety of items to be considered, such as the number of tractive electric locomotives (13) of the coke receiving car (1), the shape of the coke receiving car (1), the number of sets of discharge equipment (discharge gate (5)) provided at the coke receiving car (1), and the like. For example, even when the transportation capacity of the non-rotary coke receiving car (1) is constant, one or more separation walls may be disposed at the coke receiving car (1) in a direction orthogonal to an advancing direction thereof to provide two or more chambers, and the discharge gate may be disposed at each of the chambers. Accordingly, the red-hot coke may be divided and charged to each chamber. This may increase the number of discharging operations of the red-hot coke, thereby increasing the discharging time of the red-hot coke. However, the width, length, and height of the discharge chute of the coke receiving car (1) may be decreased. As a result, the depth of a pit in which the rails (12) for the coke bucket car (1) are provided becomes small, and the distance of hoisting the coke by the hoist (4) becomes small, thereby promoting significant cost reduction.

Owing to these reasons, it is necessary to determine the shape of the non-rotary coke receiving car (1) by comprehensively considering the arrangement conditions (transportation cycle of coke) of the CDQ system (10), the shape of the discharge chute (2), and the like.

It is obvious that the capacity of one non-rotary coke receiving car (1) needs a coke amount from one oven chamber or more, however, it is unreasonable if the capacity holds a coke amount from two or more oven chambers in view of ancillary equipment. Thus, the capacity preferably corresponds to a coke amount from one oven chamber.

The shape of the non-rotary coke receiving car (1) is preferably rectangular similarly to the shape of the existing coke wet quenching car due to the small width of a space between the front of the coke oven and the rails, for receiving the red-hot coke. The bottom of the non-rotary coke receiving car is inclined toward the coke bucket (3, 3'), or the bottom of the non-rotary coke receiving car (1) has a dump function so as to prevent the red-hot coke from remaining when the red-hot coke is discharged from the non-rotary coke receiving car (1). In addition, the non-rotary coke receiving car (1) has the discharge gate (5) that can control the amount of discharge of the red-hot coke, the gate being disposed at a position of the discharge equipment (16).

(2) Discharge Equipment (16)

The discharge equipment (16) includes the discharge chute (2) and the dust collector hood (11) as shown in FIGS. 1, 3, 5 and 7. An expansion assistant discharge chute (20) may be attached to the discharge chute (2) if necessary.

(3) Coke Bucket (3, 3')

At least two coke buckets (3, 3') are newly provided adjacently to the rails (12) for the existing coke wet quenching car, and the capacity of each bucket preferably ranges from 20 to 30 ton per bucket. In this case, one coke bucket may receive the red-hot coke by a coke amount from two or three oven chambers. The coke bucket (3, 3') may employ a rotary coke bucket (3) or a non-rotary coke bucket (3'). The rotary coke bucket (3) is more preferable because the particle size segregation in circumferential direction of the coke is decreased, the particle size distribution in the CDQ furnace becomes uniform, flow deflection of gas in the furnace is reduced, and accordingly, thermal efficiency is enhanced. However, the present invention is not limited thereto, and may attain the object of the present invention even when employing the non-rotary coke bucket (3').

The shape of the rotary coke bucket (3) or the non-rotary coke bucket (3') is not limited particularly. The shape of the rotary coke bucket (3) is determined in view of its interference with respect to the peripheral equipment. Since the rotary coke bucket (3) receives the red-hot coke while rotating, the shape thereof is preferably cylindrical to achieve the balance while rotating. The coke bucket structure includes a bucket body corresponding to the amount capacity, a hanging metal part detachably attached to the hoist (4), and a gating device provided at the bottom of the bucket and being capable of discharging the red-hot coke by way of a CDQ charging chute (9).

(4) Transporting Device (7, 15) for Coke Bucket

A transporting device (7, 15) for the coke bucket newly provided adjacently to the rails (12) for the existing coke wet quenching car may be preferably the coke bucket car (7) or the turning table (15), which is self-propelled or provided with an external driver. Rails (12) for the coke bucket car (7) or the turning table (15) is disposed on the ground or at an underground pit (14) so as to secure a drop with respect to the rails (12) for the non-rotary coke receiving car (1). The rails (12) for the coke bucket car (7) are preferably parallel to the rails (12) for the non-rotary coke receiving car (1), or looped rails.

(5) Hoist (4)

The capability of the hoist (4) is comprehensively determined on the basis of its hoist power (hoist load and hoist speed) corresponding to the hanging load with the above-described red-hot coke mounted, and its travel power (travel load and travel speed) related to the time cycle necessary for a coke processing amount of the coke oven chamber. The primary structure of the hoist (4) includes a hanging tool and a hoist winch for attaching/detaching and lifting up/down the coke bucket (3, 3') having the red-hot coke mounted, as well as a travel car and a travel driver for reciprocation between the uppermost hoist position and the CDQ charging chute (9). In addition, a coke bucket cover (8) is attached to the hanging tool, so that the coke bucket (3, 3') is covered with the coke bucket cover (8) when the coke bucket is hung, thereby preventing heat loss, and protecting the hoist from being exposed to radiant heat of the red-hot coke during the transportation.

Figure 11:
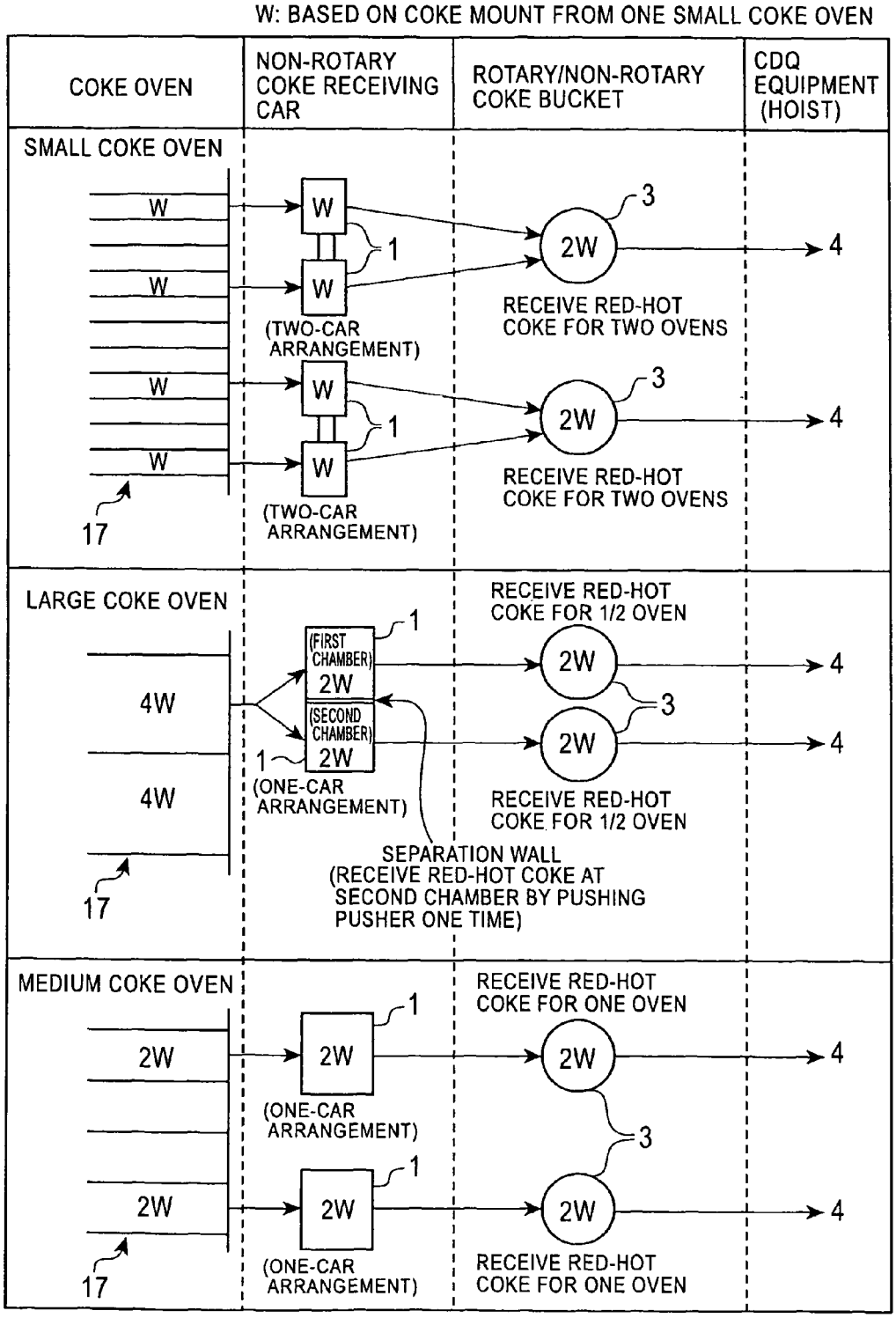
FIG. 11 is a flow chart showing equipment and a method for transporting red-hot coke according to the present invention.

As described above, in the case of the small coke oven as shown in the row for the small coke oven in FIG. 11, if the equipment according to the present invention is used, the two or more non-rotary coke receiving cars (1) may receive the red-hot coke by a coke amount from two or more oven chambers, and the red-hot coke with the coke amount from two or more oven chambers may be discharged to the one rotary coke bucket (3) or non-rotary coke bucket (3') even when the amount capacity of the coke bucket (3, 3') does not correspond to the coke amount from one oven chamber. Accordingly, the capacity of the coke bucket (3, 3') and the optimum cycle time of the hoist (4) that are suitable for the capability of the CDQ system (10) may be provided.

(B) Case for Large Coke Oven (Large Coke Oven being Defined Such that Coke Amount from One Oven is 30 Ton or More)

FIGS. 5 and 6 are drawings for a case where a coke amount from one oven chamber is large and the number of pushing operations is small (corresponding to a large coke oven).

The inner portion of the large non-rotary coke receiving car (1) is divided into at least two chambers by way of a separation wall (21), and two or more discharge gates (5) are prepared to receive the coke out of the coke oven. Such a large non-rotary coke receiving car (1) travels to the discharge equipment (16) (discharge position (A)), the rotary coke bucket (3) on the No. 1 car of the coke bucket car (7) waiting at the underground pit (14) receives a half of the red-hot coke mounted in the coke receiving car (a coke amount from a first chamber shown in FIG. 6), through the discharge chute (2). The reason of using the rotary type is for decreasing the particle size segregation of coke as mentioned before. Then, the rotary coke bucket (3) (No. 1 car) is moved to the hoist position, and hoisted by the hoist (4) to be transported to the CDQ system (10). At the time when the No. 1 car is moved to the hoist position, or before that timing, the No. 2 car having the empty rotary coke bucket (3) mounted thereon has been already moved to another receiving position (B). Accordingly, the No. 2 car can receive the residual half of the red-hot coke (a coke amount from a second chamber shown in FIG. 6) promptly. In this moment, the preceding coke bucket discharges the coke to the CDQ system (10), and is restored to the No. 1 car (empty car) as an empty coke bucket. In the next hoist cycle, the rotary coke bucket (3) on the No. 2 car of the coke bucket car (7), which is arranged in the underground pit (14) and has received the above-mentioned residual half of the red-hot coke, is moved to the hoist position, and is also hoisted by the hoist (4) to be transported to the CDQ system (10).

When the coke bucket car (7) has at least two-car arrangement and the rotary coke bucket (3) having the red-hot coke mounted thereon is hung by the hoist (4), in the another rotary coke bucket (3) being an empty coke bucket is always arranged below either of two sets of the discharge equipment (16). Accordingly, the non-rotary coke receiving car (1) traveling on the main line may be operated efficiently without time loss in transportation and discharge processing of the red-hot coke from the coke oven.

Components suitable for the present invention and applied to a large coke oven will be described below.

(1) Non-Rotary Coke Receiving Car (1)

Figure 12A:
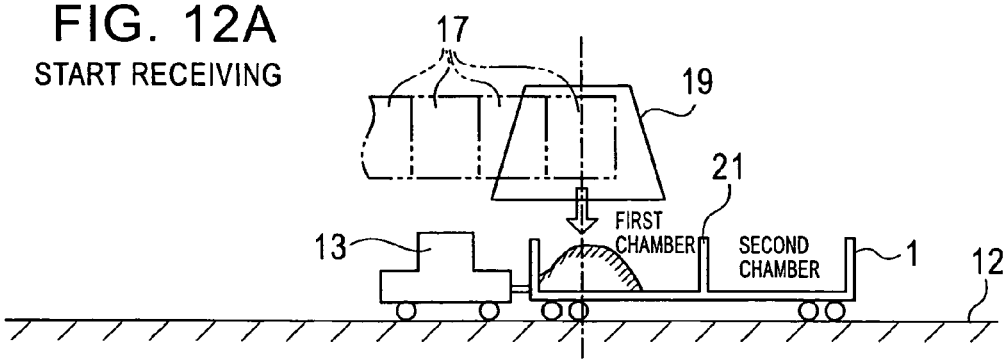
FIG. 12 is a diagram showing operation steps of a non-rotary coke receiving car for receiving red-hot coke out of the coke oven in FIG. 6.
Figure 12B:
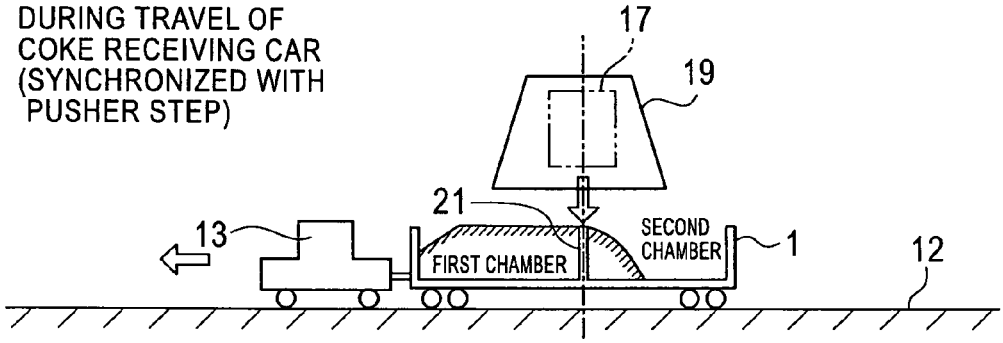
Figure 12C:
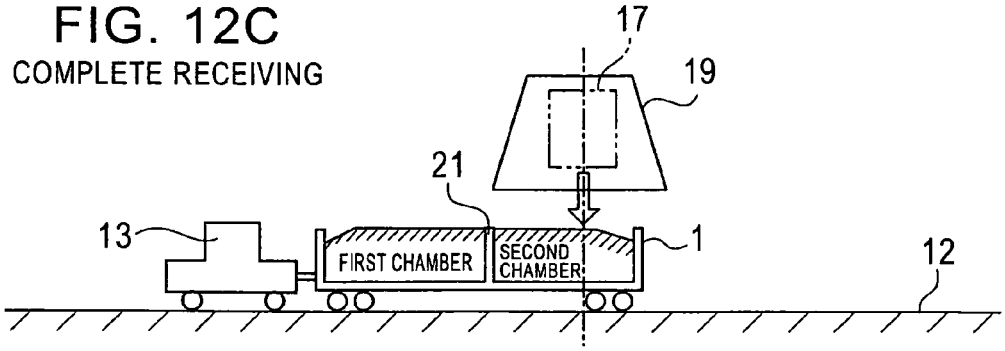

The non-rotary coke receiving car (1) in the case of the large coke oven is newly provided using the existing rails (12) for the coke wet quenching car. Or, the existing coke wet quenching car may be used as a substitute. The capacity of one large non-rotary coke receiving car (1) preferably ranges from 30 to 60 ton per car. The shape of the non-rotary coke receiving car (1) is preferably rectangular in plan view on account of the narrow space between the front of the coke oven and the rails (12). In addition, at least one separation wall (21) is provided at the center portion of the non-rotary coke receiving car (1) to divide the inner portion into at least two chambers, so that the red-hot coke out of the oven chamber (17) is distributed into two or more chambers by way of the separation wall (21). Note that the number of the separation walls of the coke receiving car (1) is three or less at a maximum, and thus, the number of the chambers becomes four or less. FIG. 12 shows a exemplary receiving operation of the non-rotary coke receiving car (1) for receiving the red-hot coke out of the coke oven. In this embodiment, the coke receiving car (1) is moved synchronously with a pushing step of a pusher, thereby equally receiving the red-hot coke. The bottom of the non-rotary coke receiving car (1) is inclined toward the coke bucket (3, 3'), or the bottom of the non-rotary coke receiving car (1) has a dump function so as to prevent the red-hot coke from remaining when the red-hot coke is discharged from the non-rotary coke receiving car (1). In addition, the non-rotary coke receiving car (1) has the discharge gate (5) that can control the amount of discharge of the red-hot coke, the gate being disposed at a position of the discharge equipment (16).

Since the discharge equipment (16), the coke bucket (3, 3'), the transporting device (7, 15) of the coke bucket, and the hoist (4) may employ configurations similar to that in the above-described case for the small coke oven, the description of these configurations will be omitted.

In the case of the large coke oven as shown in the row for the large coke oven in FIG. 11, if the equipment according to the present invention is used, the large non-rotary coke receiving car (1) may receive the red-hot coke by a coke amount from one oven chamber by distributing the coke into two or more chambers, and the red-hot coke may be discharged to the rotary coke bucket (3) or the non-rotary coke bucket (3') in accordance with its capacity even when the amount capacity of the coke bucket (3, 3') does not correspond to the coke amount from one oven chamber. Accordingly, there may be provided transporting equipment for red-hot coke which does not need a large CDQ system (10) and a overcapacity of hoist with excessive equipment.

(C) Case of Medium Coke Oven (Medium Coke Oven being Defined Such that Coke Amount from One Oven is More than 20 Ton and Less than 30 Ton)

Figure 10:
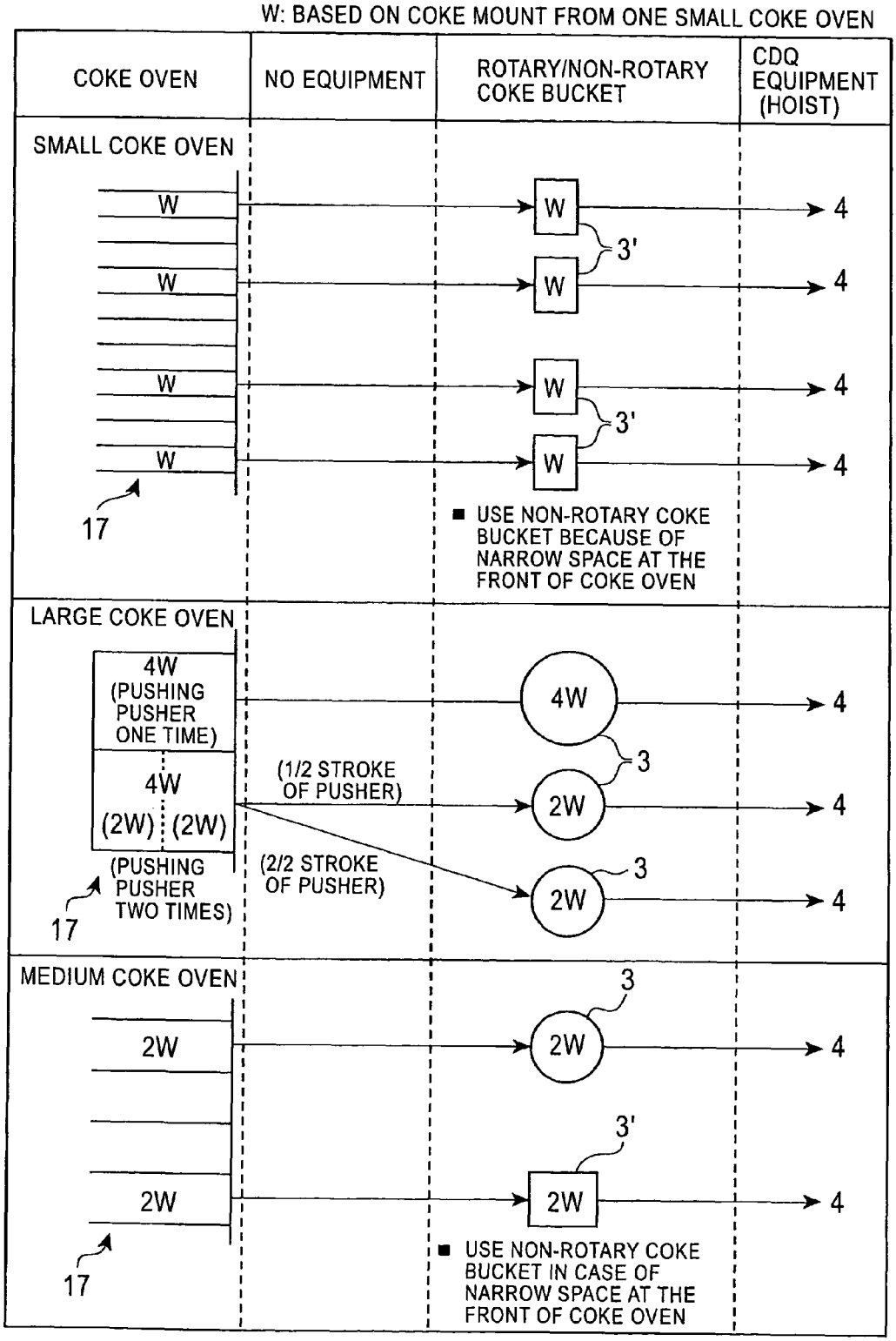
FIG. 10 is a flow chart showing equipment and a method for transporting red-hot coke according to the related art.

As shown in the lower row for a medium coke oven in FIG. 10, when the rotary coke bucket (3) receives the red-hot coke from the one medium coke oven chamber, the configuration of the related art may be utilized without any problem instead of using the configuration according to the present invention. However, if the width of a space between the front of the coke oven and the rails is small and the rotary coke bucket (3) may not be installed therein, the present invention may be applied. By newly providing the rotary coke bucket (3), the particle size segregation of the coke is decreased in circumferential direction, the particle size distribution in the CDQ furnace becomes uniform, flow deflection of gas in the furnace is reduced, and accordingly, thermal efficiency is enhanced. In addition, the quality of coke is stabilized.

Components suitable for the present invention and applied to a medium coke oven will be described below.

(1) Non-Rotary Coke Receiving Car (1)

The non-rotary coke receiving car (1) in the case of the medium coke oven is newly provided using the existing rails (12) for the coke wet quenching car. Or, the existing coke wet quenching-car may be used as a substitute. The specifications of the non-rotary coke receiving car (1) is necessary to be determined by comprehensively considering the arrangement conditions of the subject coke oven and CDQ system (10) (transportation cycle of coke), the number of tractive electric locomotives (13) of the coke receiving car, the shape of the coke receiving car (1), the shape of the discharge chute, and the like. It is obvious that the capacity of one non-rotary coke receiving car (1) is necessary to correspond to a coke amount from one oven chamber or more, however, it is unreasonable if the capacity holds a coke amount from two or more oven chambers in view of ancillary equipment. Thus, the capacity preferably corresponds to a coke amount from one oven chamber.

The shape of the non-rotary coke receiving car (1) is preferably rectangular similarly to the shape of the coke wet quenching car due to the small width of a space between the front of the coke oven and the rails, for receiving the red-hot coke. The bottom of the non-rotary coke receiving car (1) is inclined toward the rotary coke bucket (3), or the bottom of the non-rotary coke receiving car (1) has a dump function so as to prevent the red-hot coke from remaining when the red-hot coke is discharged from the non-rotary coke receiving car (1). In addition, the non-rotary coke receiving car (1) has, in its inner side and at its outlet potion, the discharge gate (5) that can control the amount of discharge of the red-hot coke, the gate being disposed at a position of the discharge equipment (16).

(2) Rotary Coke Bucket (3)

At least two rotary coke buckets (3) are newly provided adjacently to the rails (12) for the existing coke wet quenching car, and the capacity of each bucket preferably ranges from 20 to 30 ton per bucket. The shape of the rotary coke bucket (3) is determined in view of its interference with respect to the peripheral equipment. Since the rotary coke bucket (3) receives the red-hot-coke while rotating, the shape thereof is preferably cylindrical to reduce the particle size segregation in circumferential direction, and achieve the balance while rotating. The coke bucket structure includes a bucket body corresponding to the amount capacity, a hanging metal part detachably attached to the hoist (4), and a gating device provided at the bottom of the bucket and being capable of discharging the red-hot coke by way of a CDQ charging chute (9).

Since the discharge equipment (16), the transporting device (7, 15) of the coke bucket, and the hoist (4) may employ configurations similar to that in the above-described case for the small coke oven, the description of these configurations will be omitted.

In the case of the medium coke oven, as shown in the row for the medium coke oven in FIG. 11, the present invention may be applied if the width of a space between the front of the coke oven and the rails, for receiving the red-hot coke, is small, and the rotary coke bucket (3) may not be installed therein. By newly providing the rotary coke bucket (3), the particle size segregation of the coke in circumferential direction is decreased, the particle size distribution in the CDQ furnace becomes uniform, flow deflection of gas in the furnace is reduced, and accordingly, thermal efficiency is enhanced.

EXAMPLE 1

An example using the transporting equipment according to the present invention will be described.

Table 1 shows:

(1) comparison of the processing cycle of the hoist (4) using the transporting equipment of the present invention for the small coke oven, with respect to that of the related art, and (2) comparison of the processing cycle of the hoist using the transporting equipment of the present invention for the large coke oven, with respect to that of the related art.

In either case, the processing amount of coke of the coke oven is 189 ton/hr, and hence, the transporting capability of coke necessary for the hoist is 189 ton/hr.

(1) Regarding the case of the small coke oven with the coke amount from one oven chamber being 13.5 ton, in the related art (hoist amount of 13.5 ton at a time), the processing cycle of the hoist (4) is 10 cycles/hr at a maximum since the shortest cycle time is 6 min/cycle, and accordingly the transporting processing is 10 oven chambers/hr (135 ton/hr). Therefore, the transportation of the red-hot coke is insufficient, and this means that the productivity of the coke oven is decreased to 135 ton/hr.

On the other hand, when the transporting equipment of the present invention is used, and the capacity of the rotary coke bucket (3) is determined to 27 ton, the processing cycle of the hoist (4) is 7 cycles/hr at a maximum since a cycle time of the hoist (4) is 8.6 minutes/cycle which is longer than the shortest cycle time of the hoist of 6 minutes/cycle. Accordingly, the transportation capability achieves 14 coke oven chambers/hr (189 ton/hr), thereby sufficiently transporting the red-hot coke to the CDQ system (10). The use of the transporting equipment of the present invention do not cause decrease in the productivity of the coke oven.

(2) Regarding the case of the large coke oven with the coke amount from one oven chamber being 54 ton, in the related art (hoist amount of 54 ton at a time), the processing cycle of the hoist (4) is 3.5 cycles/hr since the cycle time of the hoist (4) is 17.1 minutes/cycle. Since the rotary coke bucket (3) has a heavy load such as 54 ton, the hoist power becomes excessively large, and the increase in weight of the hoist as well as reinforcement of the structure for the hoist are necessary, resulting in serious cost increase. When the transporting equipment of the present invention is used; and the capacity of the rotary coke bucket (3) is determined to 27 ton, the processing cycle of the hoist (4) became 7 times/hr at a maximum since a cycle time of the hoist (4) is 8.6 minutes/cycle which is longer than the shortest cycle time of 6 minutes/cycle of the hoist (4). Accordingly, the processing is available according to the capability of the hoist (4) of the related art, even when the capacity of the coke bucket is 27 ton, which is a half of the value of the related art. Therefore, this embodiment according to the present invention does not need overcapacity of a hoist.

INDUSTRIAL APPLICABILITY

By using the transporting equipment according to the present invention for transporting the red-hot coke from the oven chamber (17) of the coke oven to the CDQ system (10), the CDQ system (10) may be operated efficiently regardless of the degree of the coke amount from one oven chamber.

TABLE 1

| Case | | Coke oven side | | | Coke dry quenching system (CDQ) side | | | | Comprehensive evaluation |
|---|---|---|---|---|---|---|---|---|---|
| | | Coke amount from one oven ton/oven | Number of oven processed (at peak) oven/hr | Coke processing amount ton/hr | Coke bucket capacity ton | Required coke transporting amount of hoist ton/hr | Required number of processing cycle of hoist cycle/hr | Required time for one cycle of hoist min/cycle | |
| small coke oven correspondence | Embodiment of related art | 13.5 | 14 | 189 (13.5 × 14) | 13.5 | 189 (13.5 × 14) | 14 | *4.3 (60/14) = NG | C *As a result, since the shortest one cycle time |

TABLE 1-continued

| Case | | Coke oven side | | | Coke dry quenching system (CDQ) side | | | | | |
|---|---|---|---|---|---|---|---|---|---|---|
| | | Coke amount from one oven ton/oven | Number of oven processed (at peak) oven/hr | Coke processing amount ton/hr | Coke bucket capacity ton | Required coke transporting amount of hoist ton/hr | Required number of processing cycle of hoist cycle/hr | Required time for one cycle of hoist min/cycle | | Comprehensive evaluation |
| | | | | | | | | | | is 6 min, power of hoist is not enough. |
| | Embodiment of present invention | 13.5 | 14 | 189 (13.5 × 14) | 27 | 189 (27 × 7) | 7 | 8.6 (60/7) | A | Hoist power of related art is enough. |
| Large coke oven correspon-dence | Embodiment of related art | 54 | 3.5 | 189 (54 × 3.5) | *54 | 189 (54 × 3.5) | 3.5 | 17.1 (60/3.5) | B | *Since bucket has heavy load, hoist power becomes excessive, resulting in cost increase. |
| | Embodiment of present invention | 54 | 3.5 | 189 (54 × 3.5) | 27 | 189 (27 × 7) | 7 | 8.6 (60/7) | A | Hoist power of related art is enough. |

A: suitable
B: less suitable
C: not suitable

The invention claimed is:

1. A system for transporting red-hot coke, comprising:

a non-rotary coke receiving car which travels on a first rail for receiving coke from a coke oven chamber;

a coke bucket car for receiving the coke discharged from the coke receiving car, the coke bucket car having at least two rotary coke buckets mounted thereon, the coke bucket car travels along a second rail;

one or two sets of discharge devices, each containing a discharge chute and a dust collector hood, which discharges the coke from the non-rotary coke receiving car to the at least two rotary coke buckets mounted on the coke bucket car; and a hoist for hoisting and transporting the at least two rotary coke buckets to a coke dry quenching unit;

wherein the coke bucket car is movable to positions where the discharge device is set for discharging the red-hot coke to any of the at least two rotary coke buckets mounted on the coke bucket car.

2. The system according to claim 1, further comprising two sets of the discharge device.

3. The system according to claim 1, wherein the second rail, on which the coke bucket car travels, is a circular rail, or a straight-line rail that is parallel to the first rail on which the non-rotary coke receiving car travels.

4. The system according to claim 1, wherein the at least two rotary coke buckets have a capacity equivalent to an amount of coke from two or more of the coke oven chambers.

5. The system according to claim 1, wherein the non-rotary coke receiving car is divided into two chambers, each of which has a discharge gate.

6. A method for transporting red-hot coke, comprising the steps of:

(i) discharging coke from a coke oven chamber into a non-rotary coke receiving car which has a first chamber and a second chamber;

(ii) discharging a portion of the coke from the first chamber to a first rotary coke bucket which contains red-hot coke;

(iii) hoisting and transporting the first rotary coke bucket;

(iv) discharging the remainder of the coke from the second chamber to a second rotary coke bucket which contains red-hot coke;

(v) hoisting and transporting the second coke bucket, and (vi) charging the red-hot coke from the first rotary coke bucket and the second rotary coke bucket into a coke dry quenching system.

7. The method for transporting red-hot coke according to claim 6, wherein an amount of coke from the coke oven chamber is 30tons or more.

* * * * *